US006719411B2

(12) United States Patent
Tomita et al.

(10) Patent No.: US 6,719,411 B2
(45) Date of Patent: Apr. 13, 2004

(54) INK JET RECORDING HEAD

(75) Inventors: Shinya Tomita, Hitachinaka (JP); Toshitaka Ogawa, Hitachinaka (JP); Satoru Tobita, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/284,303

(22) Filed: Oct. 31, 2002

(65) Prior Publication Data

US 2003/0081081 A1 May 1, 2003

(30) Foreign Application Priority Data

Oct. 31, 2001 (JP) ..... P2001-334499

(51) Int. Cl.[7] ..... B41J 2/045

(52) U.S. Cl. ..... 347/70

(58) Field of Search ..... 347/68, 70–72

(56) References Cited

U.S. PATENT DOCUMENTS 4,364,068 A * 12/1982 Lewis ..... 347/71
5,381,171 A * 1/1995 Hosono et al. ..... 347/72
6,186,619 B1 * 2/2001 Usui et al. ..... 347/72

* cited by examiner

*Primary Examiner*—Judy Nguyen
(74) *Attorney, Agent, or Firm*—McGuireWoods LLP

(57) ABSTRACT

An ink jet recording head that enables a reduction in the amount of piezoelectric plate consumed, so that costs can be lowered, without lowering efficiency of piezoelectric actuators, even if the piezoelectric actuators are only roughly fixed to the housing, and that also enables accurately and easily positioning the piezoelectric actuators with respect to a diaphragm that defines an ink channel. Assuming that mB is the mass (kg) of the base 3 to which the piezoelectric actuator 5 is fixed and $T_{fall}$ is the rising edge time (s) of the drive signal that drives the piezoelectric actuator 5, the spring modulus determined from mB and $T_{fall}$ is $2\times mB/T_{fall}^2 \geqq 5.0\ e^6$ (N/m). Therefore, the displacement of the piezoelectric actuator can be efficiently transmitted to the ink chamber regardless of the spring modulus of the adhesive agent used to fix the base to the housing.

6 Claims, 2 Drawing Sheets

INK JET RECORDING HEAD

BACKGROUND OF THE INVENTION

1. Field of the Invention

The present invention relates to an ink jet recording head, and more particularly to a compact ink jet recording head with a high density of ink ejecting nozzles.

2. Description of the Related Art

Ink jet recording heads include a piezoelectric actuator and an ink chamber filled with ink. The piezoelectric actuator expands or contracts in accordance with a voltage applied thereto. This expansion or contraction applies pressure to ink in the ink chamber and ejects ink droplets from a nozzle in fluid communication with the ink chamber. To insure that the proper pressure is applied to the ink, the piezoelectric actuator must be capable of generating a certain amount of displacement.

In view of the requirement that a plurality of piezoelectric actuators be mounted on each recording head, the piezoelectric actuator needs to be very small. Accordingly, the piezoelectric actuator must be applied with a high voltage in order to obtain sufficient displacement to properly eject ink droplets. This causes problems such that the electronic components that make up the drive circuitry of the piezoelectric actuators need to be durable to a high voltage. Also, because the piezoelectric actuators can come into contact with ink, the piezoelectric actuators need to have high dielectric properties.

One solution to the above problems is using a piezoelectric actuator of a type in which a plurality of piezoelectric elements are stacked. Such type of piezoelectric actuator can use a lower voltage, so can overcome the above-described problems. However, the fixed end of the piezoelectric actuator must be fixed to a housing, and also needs to be very rigid when fixed to insure that displacement generated by the piezoelectric actuator is efficiently transmitted to the ink chamber.

Specifically, the fixed end of the piezoelectric actuator is rigidly secured to the housing while adjusting the position of the free end of the piezoelectric actuator to be in confronting relation with a nozzle. The free end of the piezoelectric actuator is attached to a diaphragm that defines an ink chamber. The diaphragm is also supported by the housing. To assemble the recording head, a plurality of piezoelectric actuators is mounted to be in alignment with the nozzle array. However, assembling the recording head in this manner is difficult due to the piezoelectric actuators being so small in size. Increasing the size of the piezoelectric elements would raise production costs because a large amount of piezoelectric plates is needed.

SUMMARY OF THE INVENTION

It is an object of the present invention to overcome the above-described problems and to provide an ink jet recording head that enables a reduction in the amount of piezoelectric plate consumed, so that costs can be lowered, without lowering efficiency of the piezoelectric actuators, even if the piezoelectric actuators are only roughly fixed to the housing, and that also enables accurately and easily positioning the piezoelectric actuators with respect to the member that defines an ink channel.

To achieve the above and other objects, there is provided an ink jet recording head that includes a base having a mass mB (kg), a piezoelectric actuator, a nozzle plate formed with a nozzle, a diaphragm having a spring module kd, and an ink chamber in fluid communication with the nozzle. The piezoelectric actuator having a fixed end secured to the base and a free end opposite the fixed end contracts and extends in response to a drive signal having an edge rising time $T_{fall}$ (s). The free end of the piezoelectric actuator is attached to the diaphragm. The ink chamber has an inner space to be filled with ink having a spring module ki. The inner space is increased and decreased to eject the ink from the nozzle in accordance with contraction and expansion of the piezoelectric actuator. With the ink jet recording head thus constructed, a relation of $2\times mB/T_{fall}^2 \geqq 5.0\ e^6$ (N/m) is met according to the invention.

It is desirable that the piezoelectric actuator be formed with a plurality of piezoelectric elements and a plurality of electrically conductive plates alternately stacked one on the other. The plurality of electrically conductive plates serve as electrodes to which the drive signal is applied.

In addition to the above-noted relation, when the base is fixedly secured by a fixing material having a spring module kc2, a relation of $2\times mB/T_{fall}^2 \geqq kc2$ is met according to another aspect of the invention. Further, various components of the ink jet recording head may be selected to satisfy a relation of $(kd|ki)/[2\times mB/T_{fall}^2+kc2\} \geqq 5.02\ e^{-2}$.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Next, one embodiment of the present invention will be described while referring to the attached drawings.

Figure 1:
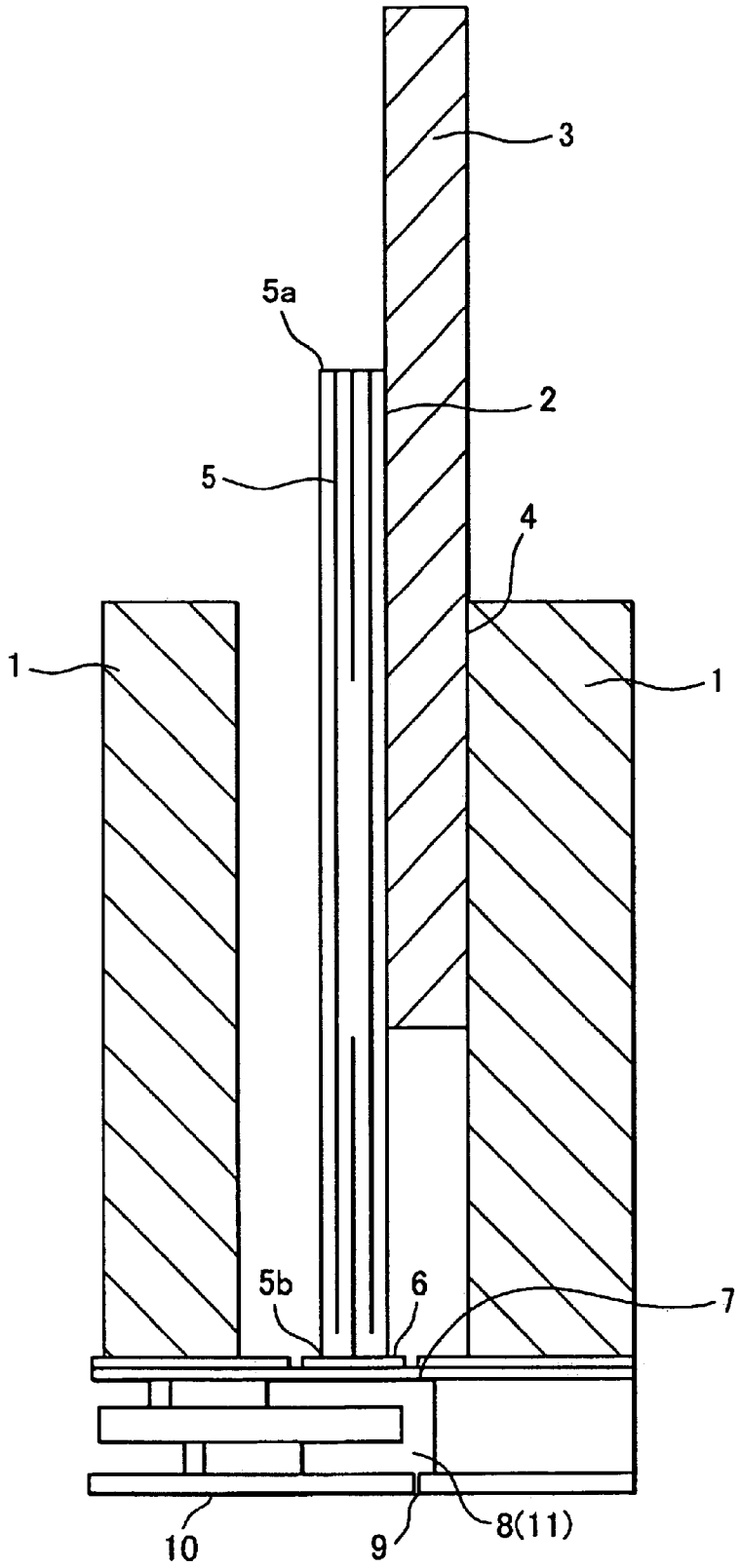
FIG. 1 is a cross-sectional view schematically showing an ink jet head according to an embodiment of the present invention.

FIG. 1 shows a part of an ink jet recording head in which only one piezoelectric actuator 8 and its associated ink chamber 8, diaphragm 7 and other components are shown. However, the actual ink jet recording head includes a plurality of piezoelectric actuators and their associated components. Specifically, the plurality of piezoelectric actuators are juxtaposed in positions corresponding to respective ones of a plurality of ink chambers and their associated nozzles formed in a nozzle plate.

As shown in FIG. 1, a piezoelectric actuator 5 is fixed at one end 5*a* to a base 3 by an adhesive agent 2. The base 3 is in turn fixed to a housing 1 by an adhesive agent 4. The other end 5*b* of the piezoelectric actuator 5 serves as a free end that contracts and extends when the piezoelectric actuator 5 is applied with a drive signal. The piezoelectric actuator 5 is formed with a plurality of piezoelectric elements and a plurality of electrically conductive plates alternately stacked one on the other. The conductive plates serve as electrodes to which the drive signal is applied.

A diaphragm 7 is attached to the free end 5*b* of the piezoelectric actuator 5 by an adhesive agent 6. The diaphragm 7 decreases and increases volume of ink chamber 8 in association with contraction and extension of the piezoelectric actuator 5. The ink chamber 8 is in fluid communication with a nozzle 9 formed in a nozzle plate 10. As shown, the nozzle plate 10 is disposed in opposition to the diaphragm 7. The diaphragm 7 and the nozzle plate 10 define the ink chamber 8 together with walls disposed between the diaphragm 7 and the nozzle plate 10.

Figure 2:
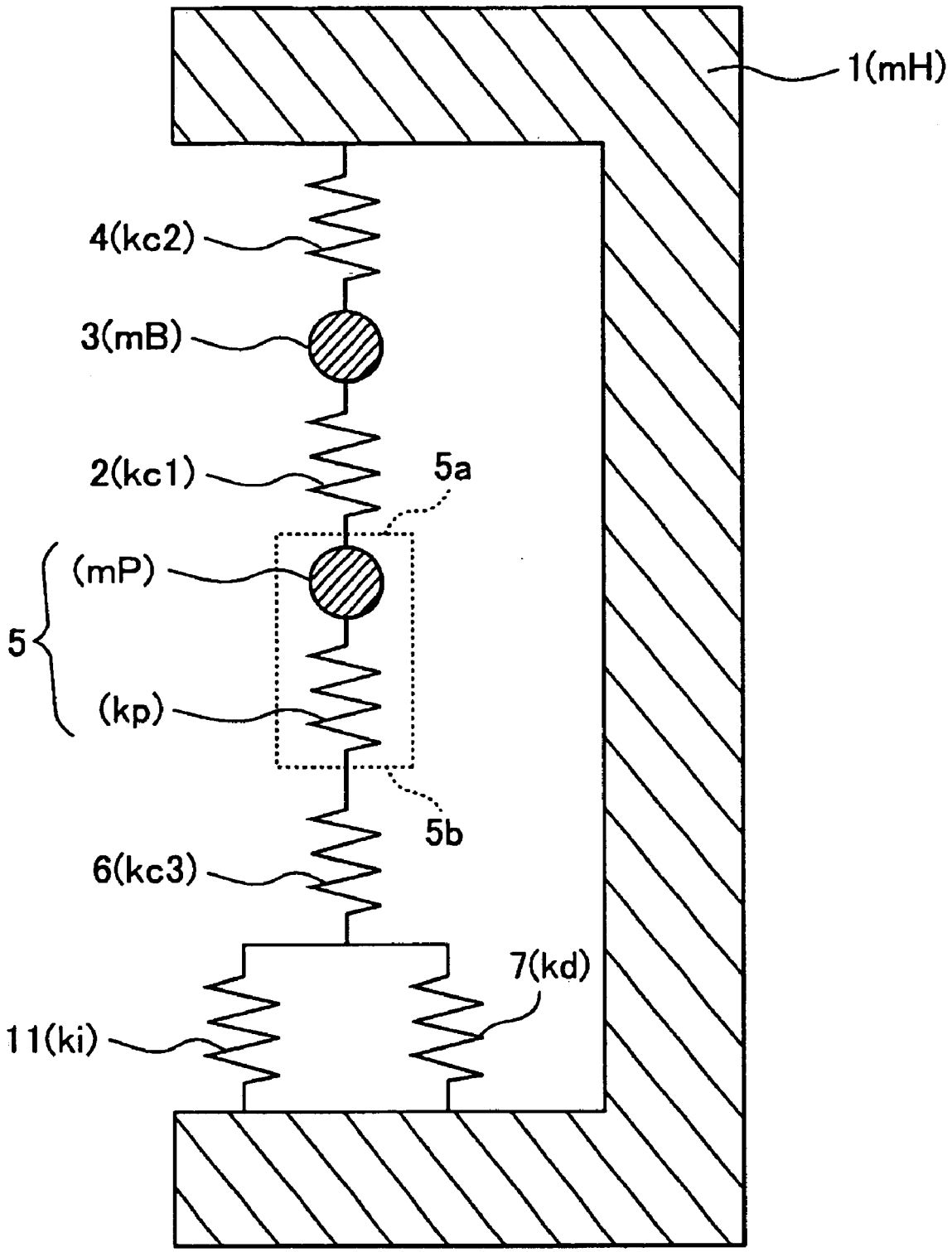
FIG. 2 is an explanatory view indicating mass and spring modulus of various components of the ink jet head of FIG. 1.

FIG. 2 is a diagram equivalent to the structure of FIG. 1. The piezoelectric actuator 5 has a mass mP. The one end 5*a* of the piezoelectric actuator 5 is adhered to the base 3 by the adhesive agent 2 with a spring modulus kc1. The base 3 has a mass mB and is adhered by the adhesive agent 4 with a spring modulus kc2 to the housing 1, which has a mass mH. The free end 5*b* of the piezoelectric actuator 5 contracts and extends with a spring modulus kp when the piezoelectric actuator 5 is applied with the drive signal. Further, the free end 5*b* is attached to the diaphragm 7 by an adhesive agent 6 with a spring modulus kc3. The diaphragm 7 follows contraction and extension of the piezoelectric actuator 5 with a spring modulus kd of the diaphragm 7 itself and with a spring modulus ki received from the ink 11 within the ink chamber 8.

The displacement δP0 of the free end of the piezoelectric actuator 5 is represented by the following equation:

$$\delta P0=\delta d+\delta c3+\delta P+\delta c1|\delta c2 \tag{1}$$

wherein:

δd is the displacement of the diaphragm 7;

δc3 is the displacement of the adhesive agent 6 that adheres the free end 5*b* to the diaphragm 7;

δP is the displacement of the piezoelectric actuator 5;

δc1 is the displacement of the adhesive agent 2 that adheres the piezoelectric actuator 5 to the base 3; and δc2 is the displacement of the adhesive agent that adheres the base 3 to the housing 1.

Assuming an ideal condition wherein no displacement occurs at the housing 1, then the displacement δc2 of the adhesive agent 4 that adheres the base 3 to the housing 1 and which has a spring modulus kc2 can be assumed to be equal to the displacement δmb of the base 3.

Assuming the base 3 moves at an acceleration αB, then the following equation can be established in view of the balance of forces in various parts:

$$\delta d\times(kd+ki)=\delta c3\times kc3=\delta P\times kP=\delta c1\times kc1=mB\times\alpha B+\delta c2\times kc2 \tag{2}$$

Assuming that the drive signal with a rising edge time $T_{fall}$ is applied to drive the piezoelectric actuator 5, the acceleration αB of the base 3 can be represented by the following equation:

$$\alpha B=2\delta c2/T_{fall}^2 \tag{3}$$

Here, it is assumed that the base 3 moves at an increasing speed with a constant acceleration during the first half of $T_{fall}$ and at a decreasing speed with a constant deceleration during the second half of $T_{fall}$.

From equation (2), the following equations can be derived:

$$\delta c3=\delta d(kd+ki)/kc3 \tag{4}$$

$$\delta P=\delta d(kd+ki)/kp \tag{5}$$

$$\delta c1-\delta d(kd+ki)/kc1 \tag{6}$$

By substituting equation (3) in equation (2):

$$(mB\times\alpha B)+\delta c2\times kc2=\{(2\times mB\times\delta c2)/T_{fall}^2)+\delta c2\times kc2=\delta c2\{2\times mB/T_{fall}^2+kc2\} \tag{7}$$

From equations (2) and (7), it can be calculated that:

$$\delta c2=\delta d(kd+ki)/\{2\times mB/T_{fall}^2+kc2\} \tag{8}$$

By substituting equations (4), (5), (6), and (8) into equation (1), then it can be determined that:

$$\delta P0=\delta d[1+(kd+ki)/kc3+(kd+ki)/kp+(kd+ki)/kc1+(kd+ki)/\{2\times mB/T_{fall}^2+kc2\}] \tag{9}$$

δP0 is the displacement of the free end 5*b* of the piezoelectric actuator 5 and δd is the actual displacement of the diaphragm 7, so δd/δP0 as close to one (1) as possible is desirable to attain the maximum displacement efficiency.

From equation (9), δd/δP0 can be represented as follows:

$$\delta d/\delta P0=1/[1+(kd+k1)/kc3+(kd+ki)/kp+(kd+ki)/kc1|(kd+ki)/\{2\times mB/T_{fall}^2+kc2\}] \tag{10}$$

Therefore, it is desirable that the following combination of values also result in a value as close to 1 as possible:

$$[1+(kd+ki)/kc3+(kd+ki)/kp+(kd+k1)/kc1+(kd+ki)/\{2\times mB/T_{fall}^2+kc2\}] \tag{11}$$

Equation (11) can be divided into the following components:

$$(kd+ki)/kc3 \tag{12}$$

$$(kd+ki)/kp \tag{13}$$

$$(kd+ki)/kc1 \tag{14}$$

$$(kd+ki)/\{2\times mB/T_{fall}^2+kc2\} \tag{15}$$

From equations (12), (13), and (14), it can be seen that the spring modulus kp of the piezoelectric actuator 5 itself and the spring modulus kp of the piezoelectric actuator 5 itself and the spring moduli kc1, kc3 of the adhesive layers 2, 6 need to be sufficiently large with respect to the spring moduli (kd+k1), which is the sum of the spring modulus kd of the diaphragm 7 and the spring modulus ki of the ink 11 in the ink chamber 8.

From equation (15), it can be seen that the value of $\{2\times mB/T_{fall}^2+kc2\}$ needs to be sufficiently large with respect to the spring moduli (kd+ki). Here, the spring modulus kc2 is the spring modulus of the adhesive agent 4. The value $(2\times mB/T_{fall}^2)$ represents the spring modulus determined by the mass mB of the base 3 and the rising edge time $T_{fall}$ of drive signal that contracts and extends the piezoelectric actuator 5.

A sufficiently large spring modulus kc2 for the adhesive agent 4 between the housing 1 and the base 3 can be secured by increasing the surface area of the adhesive agent 4 or reducing the thickness of the adhesive layer 4. However, increasing the surface area of the adhesive layer 4 interferes with attempts to increase the printing density (nozzle density) or to reduce the size of the print head. Further, if the thickness of the adhesive layer 4 is reduced, the positioning precision between the diaphragm 7 and the piezoelectric actuator 5 must be increased, which increases the costs of producing the print head.

On the other hand, the spring modulus $(2\times mB/T_{fall}^2)$ is proportional to two times the mass mB of the base 3 and inversely proportional to the square of the rising edge time $T_{fall}$ of the drive signal that contracts and extends the piezoelectric actuator 5. Therefore, in order to increase the spring modulus $(2\times mB/T_{fall}^2)$, it is necessary to reduce the value of the rising edge time $T_{fall}$ or increase the mass mB of the base 3.

However, the rising edge time $T_{fall}$ is set to an optimal value for a variety of different conditions, such as the drive conditions, the volume of the ink chamber 8, and the dimensions of the piezoelectric actuator 5. The performance of the ink jet head can suffer if the rising edge time $T_{fall}$ is changed to increase spring modulus ($2\times mB/T_{fall}^2$). For this reason, the best means for increasing the spring modulus ($2\times mB/T_{fall}^2$) is to increase the mass mB of the base 3.

It should be noted that it is possible to bring the value of δd/δP0 to close to a value of one (1) regardless of the value of the spring modulus kc2. Also, in this case, the value of δd/δP0 is proportional to two times the mass mB of the base 3 and inversely proportional to the square of the rising edge time $T_{fall}$.

For this reason, it is possible to set the spring modulus kc2, which can interfere with attempts to increase nozzle density and decrease the size of the print head and which can increase production costs, to any desired value and also bring the value δd/δP0 to close to a value of 1.

For example, assume that it is desired for the value δd/δP0 to be greater than or equal to 0.8 (δd/δP0≧0.8), then by setting the spring modulus ($2\times mB/T_{fall}^2$) determined by the rising edge time $T_{fall}$ and the mass mB of the base 3 to:

$$2\times mB/T_{fall}^2 \geqq 5/0e^6 \quad (16)$$

Then, a value δd/δP0 of greater than or equal to 0.8 can be achieved. This has been proven in experiments.

The following table shows various spring moduli in an example of the present embodiment.

| Region | Spring Modulus (N/m) |
|---|---|
| (kd + ki) | $3.13e^5$ |
| kc3 | $1.44e^7$ |
| kp | $2.2e^6$ |
| kc1 | $5.08e^7$ |

The values in the equations (12), (13), (14) can be determined as follows from these spring moduli values:

$$(kd+ki)/kc3=2.17e^{-2} \quad (17)$$

$$(kd+ki)/kp=1.42e^{-1} \quad (18)$$

$$(kd+ki)/kc1=6.16e^{-3} \quad (19)$$

In this example, the rising edge time $T_{fall}$ is set to 4 micro seconds for a variety of different conditions, such as the drive conditions, the volume of the ink chamber 8, and the dimensions of the piezoelectric actuator 5. The mass mB of the base 3 is set to 0.04 g to satisfy the conditions of equation (16).

In this case, even if the spring modulus kc2 is zero:

$$(kd+ki)/\{2\times mB/T_{fall}^2+kc2\}]=6.26e^{-3} \quad (10)$$

This value is sufficiently large.

In the present example, this enabled the adhesive agent 4 with spring modulus kc2 between the housing 1 and the base 3 to maintain a seal. Therefore, the adhesive agent 4 could be provided with a thickness of about 0.5 mm. Also, positional adjustment between the diaphragm 7 and the piezoelectric actuator 5 is possible. The spring modulus kc2 was about 2.54 $e^6$.

Even if the spring modulus kc2 is lower than 2.54 $e^6$, it is possible for δd/δP0 to approach 1 by obtaining a spring modulus $2\times mB/T_{fall}^2$ that is greater than or equal to 5.0 $e^6$ ($2\times mB/T_{fall}^2 \geqq 5.0\ e^6$). Therefore, as long as the spring modulus $2\times mB/T_{fall}^2 \geqq 5.0\ e^6$). Therefore, as long as the spring modulus $2\times mB/T_{fall}^2$ is within a range that is greater than or equal to the spring modulus kc2, then costs can be reduced, an easy-to-use adhesive agent can be used, the surface area of the adhesive layer can be reduced to reduce size of the print head, and the thickness of the adhesive layer 4 can be increased to enable adjustment in precision of the different components.

The value of equation (15) including the spring modulus kc2 is:

$$(kd+ki)/\{2\times mB/T_{fall}^2+kc2\}-5.02e^{-2} \quad (21)$$

The value of δd/δP0 can be determined by substituting calculated values into equation (10):

$$\delta d/\delta P0=0.825 \quad (22)$$

This shows a sufficient efficiency.

Even if the spring modulus kc2 is zero, from equations (10) and (17), the value of δd/δP0 is:

$$\delta d/\delta P0=0.811 \quad (23)$$

If a value for δd/δP0 of 0.8 is desired, then a value of 5.0 $e^{-2}$ is sufficient for (kd+k1)/{$2\times mB/T_{fall}^2$+kc2}. By setting the range of (kd|ki)/{$2\times mB/T_{fall}^2$+kcs} to ≧5.0 $e^2$ then value for δd/δP0 of ≧0.8 can be achieved so that displacement of the piezoelectric actuator 5 can be efficiently transmitted to the ink chamber 8.

To summarize, assuming that mB is the mass (kg) of the base 3 to which the piezoelectric actuator 5 is fixed and $T_{fall}$ is the rising edge time (s) of the drive signal that drives the piezoelectric actuator 5, the spring modulus determined from mB and $T_{fall}$ is $2\times mB/T_{fall}^2 \geqq 5.0\ e^6$ (N/m). Therefore, the displacement of the piezoelectric actuator 5 can be efficiently transmitted to the ink chamber 8 regardless of the spring modulus of the adhesive agent used to fix the base 3 to the housing 1.

What is claimed is:

1. An ink jet recording head comprising:

a base having a mass mB represented by a unit of kilogram;

a piezoelectric actuator that contracts and extends in response to a drive signal, the drive signal having an edge rising time $T_{fall}$ represented by second, the piezoelectric actuator having a fixed end secured to the base and a free end opposite the fixed end;

a nozzle plate formed with a nozzle;

a diaphragm having a spring module kd, the free end of the piezoelectric actuator being attached to the diaphragm; and an ink chamber in fluid communication with the nozzle, the ink chamber having an inner space to be willed with ink having a spring module ki, the inner space being increased and decreased to eject the ink from the nozzle in accordance with contraction and expansion of the piezoelectric actuator, wherein a relation of $2\times mB/T_{fall}^2 \geqq 5.0\ e^6$ represented by Newton per meter is met.

2. The ink jet recording head according to claim 1, wherein the piezoelectric actuator is formed with a plurality of piezoelectric elements and a plurality of electrically conductive plates alternately stacked one on the other, the plurality of electrically conductive plates serving as electrodes to which the drive signal is applied.

3. The ink jet recording head according to claim 1, wherein when the base is fixedly secured by a fixing material having a spring module kc2, a relation of $2\times mB/T_{fall}^2 \geqq kc2$ is met.

4. The ink jet recording head according to claim 3, wherein the fixing material is an adhesive agent.

5. The ink jet recording head according to claim 1, wherein a relation of $(kd+ki)/\{2\times mB/T_{fall}^2+kc2\}>5.02\ e^{-2}$ is met.

6. The ink jet recording head according to claim 1, wherein when the base is fixedly secured by a fixing material having a spring module kc2, a relation of $2\times mB/T_{fall}^2 \geqq kc2$ is met and also a relation of $(kd+ki)/\{2\times mB/T_{fall}^2+kc2\} \geqq 5.02\ e^{-2}$ is met.

* * * * *

UNITED STATES PATENT AND TRADEMARK OFFICE

CERTIFICATE OF CORRECTION

PATENT NO. : 6,719,411 B2
DATED : April 13, 2004
INVENTOR(S) : Shinya Tomita et al.

It is certified that error appears in the above-identified patent and that said Letters Patent is hereby corrected as shown below:

Column 6,
Line 54, delete “willed” and insert -- filled --.

Signed and Sealed this

Twelfth Day of April, 2005

JON W. DUDAS
*Director of the United States Patent and Trademark Office*